US005902040A

United States Patent [19]

Catlett

[11] Patent Number: 5,902,040

[45] Date of Patent: May 11, 1999

[54] ASPHALT PLANT INCLUDING FLAME ARRESTER

[75] Inventor: Gary Catlett, Louisville, Ky.

[73] Assignee: Gentec Equipment Company, Louisville, Ky.

[21] Appl. No.: 08/996,120

[22] Filed: Dec. 22, 1997

Related U.S. Application Data

[ 60] Provisional application No. 60/034,803, Jan. 21, 1997.

[51] Int. Cl.[6] ..... F27B 7/36

[52] U.S. Cl. ..... 366/25; 432/105; 110/226

[58] Field of Search ..... 366/4, 7, 10, 11, 366/12, 13, 22, 23, 24, 25, 54; 48/192; 432/103, 105, 107; 110/226

[56] References Cited

U.S. PATENT DOCUMENTS

| | | | |
|---|---|---|---|
| 568,735 | 10/1896 | Bright . | |
| 802,380 | 10/1905 | Emerson et al. . | |
| 2,419,625 | 4/1947 | Breese . | |
| 3,094,978 | 6/1963 | McCray et al. . | |
| 3,106,384 | 10/1963 | Preeman | 366/22 |
| 3,804,079 | 4/1974 | Schrader . | |
| 3,809,373 | 5/1974 | Brock | 366/22 |
| 3,824,065 | 7/1974 | Thompson | 432/105 |
| 3,866,888 | 2/1975 | Dydzyk | 366/25 |
| 3,995,616 | 12/1976 | Schrader . | |
| 4,229,109 | 10/1980 | Benson | 366/24 |
| 4,279,592 | 7/1981 | Grant | 432/105 |
| 4,541,346 | 9/1985 | Culliford | 432/105 |
| 4,815,398 | 3/1989 | Keating, II et al. | 432/105 |
| 4,909,730 | 3/1990 | Roussakis et al. . | |
| 5,083,870 | 1/1992 | Sindelar et al. | 366/25 |
| 5,273,355 | 12/1993 | May et al. | 366/23 |
| 5,344,229 | 9/1994 | Nath et al. | 366/25 |
| 5,378,060 | 1/1995 | Brock et al. | 366/23 |
| 5,402,603 | 4/1995 | Henley | 431/346 |

*Primary Examiner*—Tony G. Soohoo

*Attorney, Agent, or Firm*—Theresa Friitz Camoriano; Wheat, Camoriano Smith & Beres PLC

[57] ABSTRACT

An asphalt plant includes a rotary dryer, a rotary mixer, a conduit for transferring gas from the mixer to the dryer, and a flame arrester in the conduit adjacent to the dryer to prevent a fire from propagating from the dryer back through the conduit.

4 Claims, 8 Drawing Sheets

ASPHALT PLANT INCLUDING FLAME ARRESTER

This application claims the benefit of U.S. Provisional application 60/034,803 filed Jan. 21, 1997.

BACKGROUND OF THE INVENTION

The present invention relates to asphalt plants, and, in particular, to a design of an asphalt plant which solves the problem of explosions.

In many asphalt plants, air is pulled through a rotary mixer, taking with it particulates, water vapor and hydrocarbon gas. When the level of water vapor is low and the hydrocarbon content is high, the mixture may be readily combustible, and explosions have been known to occur at a number of different asphalt plants because of this combustible mixture. These explosions cause great property damage, and there is a risk of causing serious bodily injury to the people operating the plant.

SUMMARY OF THE INVENTION

The present invention provides a design of an asphalt plant which solves the explosion problem of prior art asphalt plants.

The present invention provides a flame arrester in the rotary mixer emissions duct near the dryer, so that, if the air mixture does begin to burn, the fire cannot propagate through the air duct to cause an explosion.

DESCRIPTION OF THE PREFERRED EMBODIMENT

Figure 1:
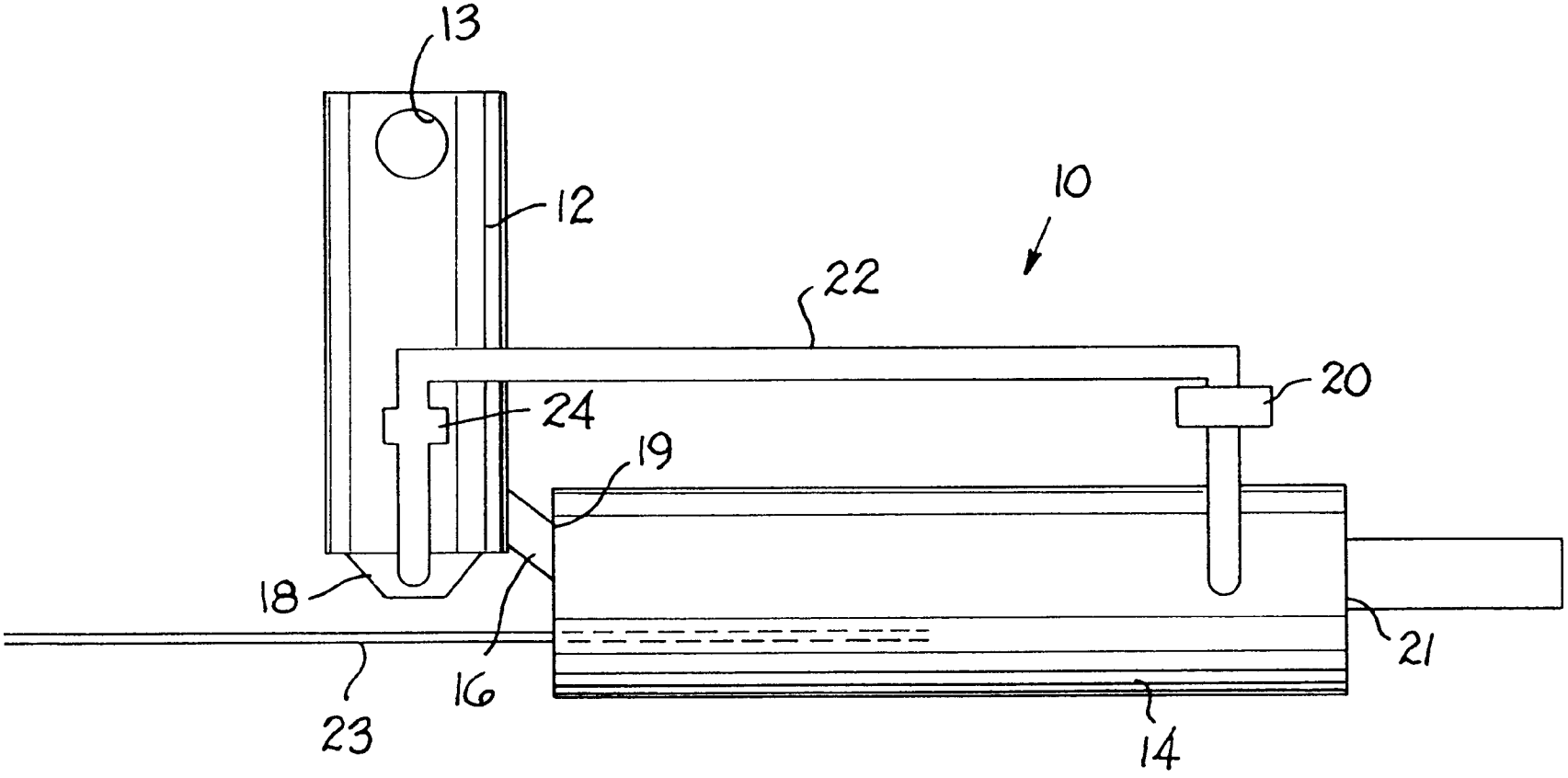
FIG. 1 is a schematic plan view of an asphalt plant made in accordance with the present invention.
Figure 2:
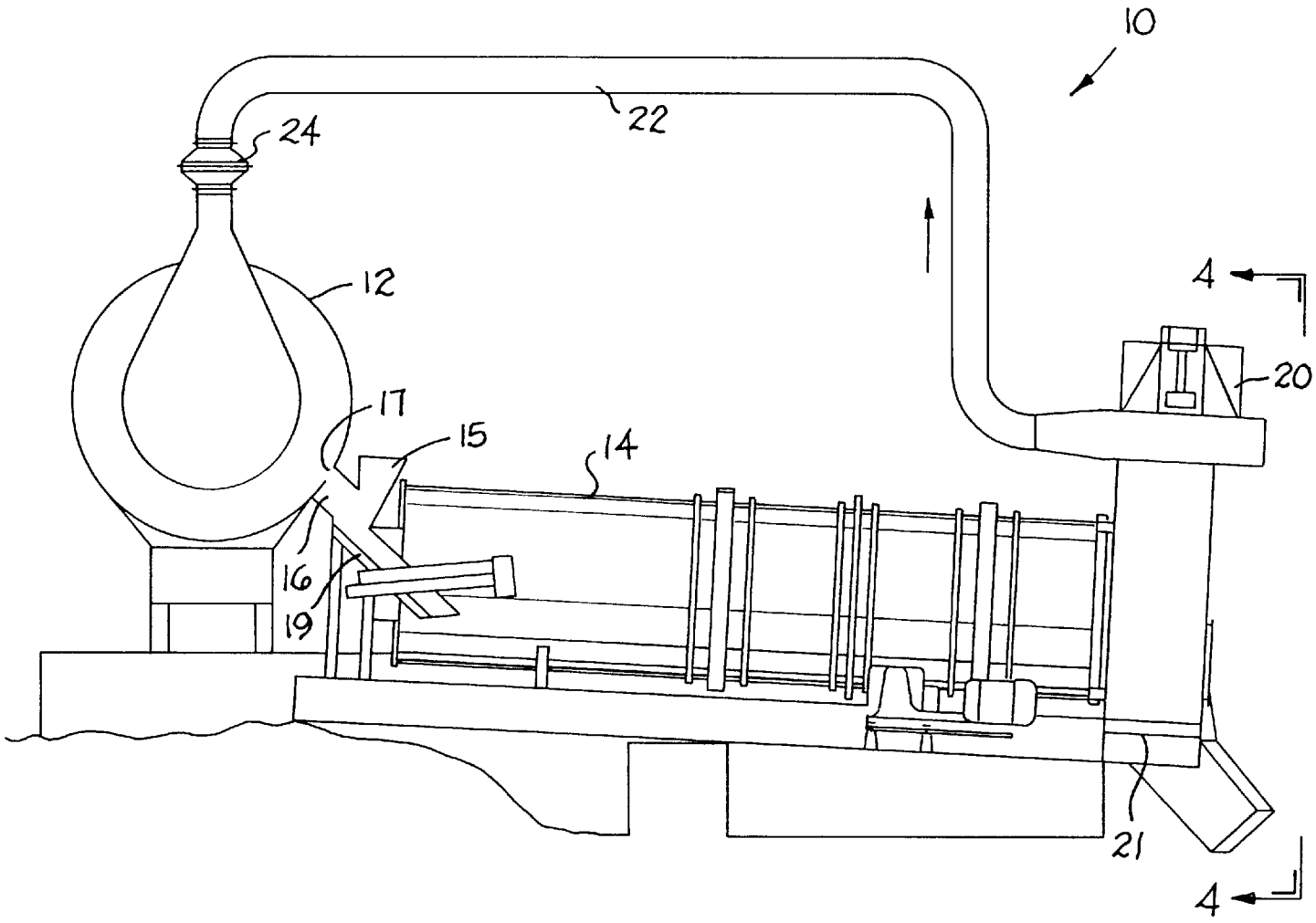
FIG. 2 is a front view of the asphalt plant of FIG. 1.
Figure 3:
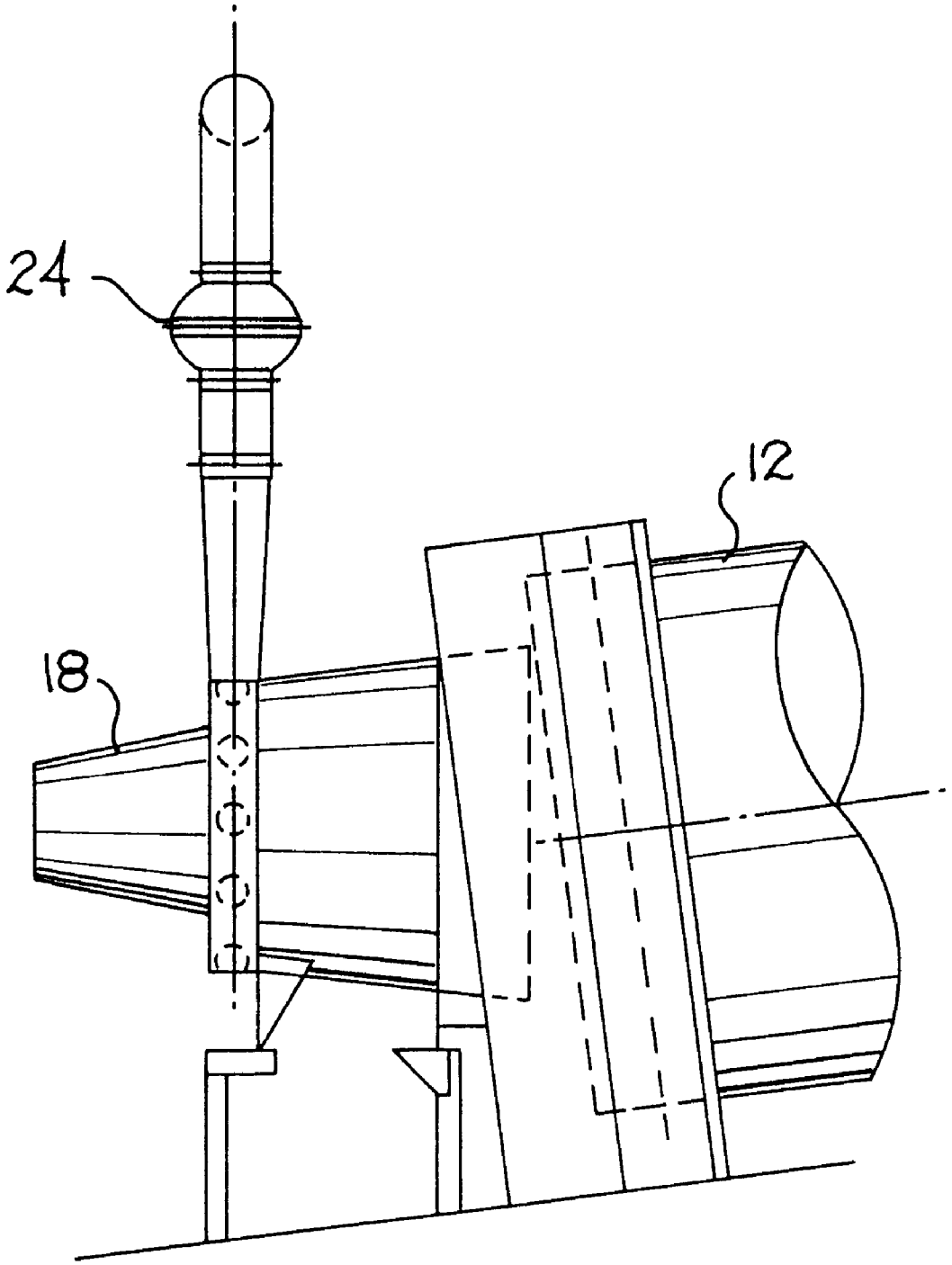
FIG. 3 is a left side view of a portion of the asphalt plant of FIG. 1.
Figure 4:
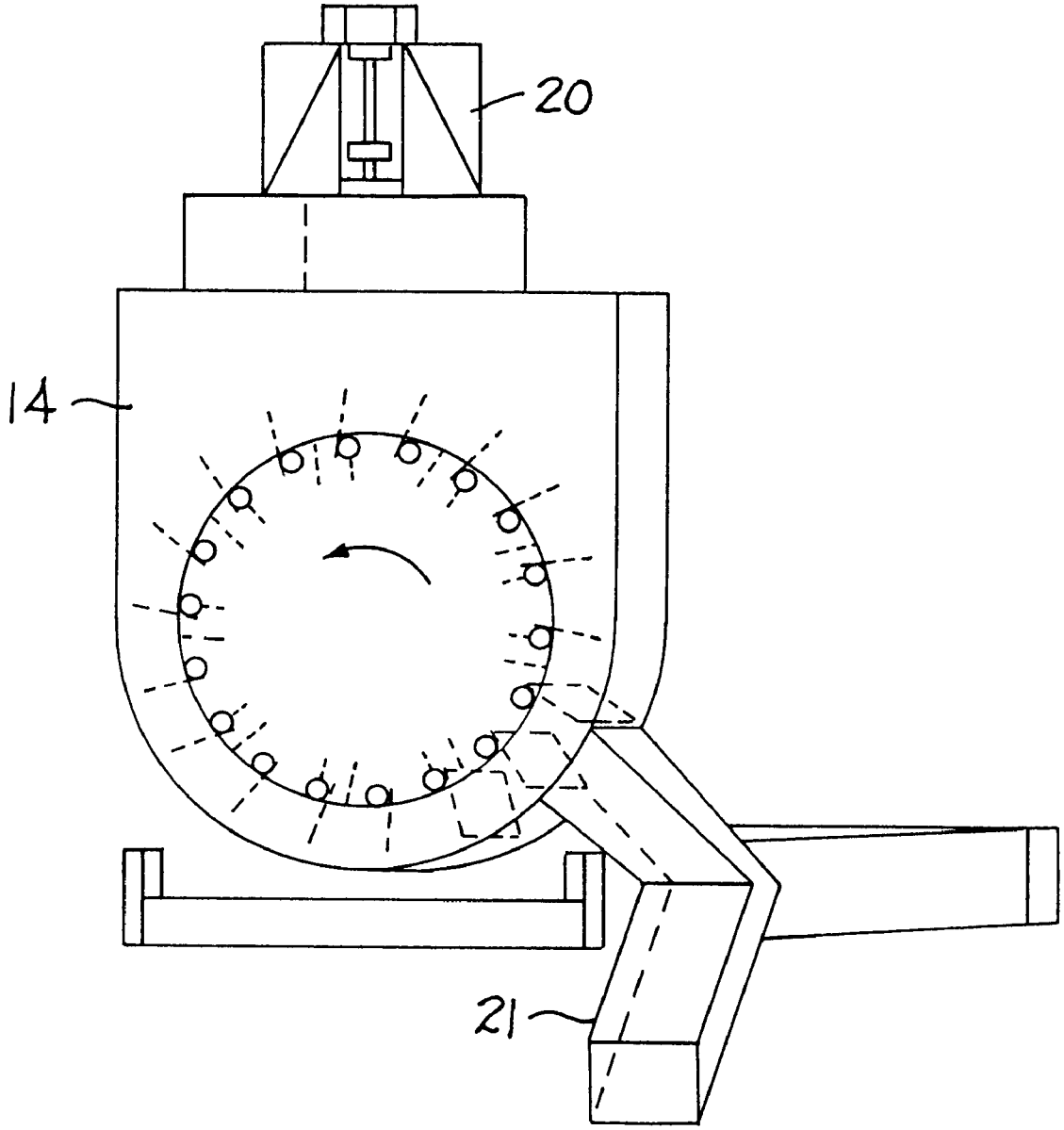
FIG. 4 is a right side view of a portion of the asphalt plant of FIG. 1.

FIGS. 1–3 show an asphalt plant 10 made in accordance with the present invention. The plant includes a rotary dryer 12, and a rotary mixer 14. The rotary dryer 12 receives aggregate (not shown) at the drier inlet 13 and heats the aggregate with a burner 18 in order to dry the aggregate. The dry aggregate then leaves the dryer 12 through a dryer outlet 17 and travels through a discharge chute 16 into the rotary mixer 14, where it is mixed with recycled asphalt and liquid asphalt to form the finished asphalt product.

The rotary mixer 14 has an inlet 19, which receives the dry aggregate from the chute 16. As shown in FIG. 2, there is also an inlet 15 for recycled asphalt product (RAP) to enter the mixer 14. Liquid asphalt enters the mixer 14 through the liquid asphalt line 23, shown in FIG. 1. The hot aggregate, RAP, and liquid asphalt are mixed together in the mixer 14 to make the finished asphalt product, which leaves the mixer 14 through an outlet 21. At the right end of the rotary mixer 14 is an emissions fan 20, which draws air through the mixer 14 and sends the air through an emissions duct 22 to the burner 18 of the dryer 12. The air contains water vapor, which was driven off of the aggregate in the dryer 12; it contains particulates or dust, which are stirred up in the mixing process; it also contains hydrocarbon gas, which vaporizes when the recycled asphalt and hot asphalt come into contact with the hot aggregate. In order to prevent explosions caused by the hydrocarbon-rich air coming into contact with the burner 18, a flame arrester 24 is placed in the emissions duct 22 just above the burner 18. Thus, the hydrocarbons in the emissions air can burn at the burner 18, but the fire cannot propagate back through the emissions duct 22 to cause an explosion. Water vapor flowing through the emissions duct 22 to the burner 18 helps reduce the emission of nitrous oxides, and the hydrocarbons that are in the emissions air are burned at the burner 18, thereby providing additional fuel for the burner and eliminating the exhaust of blue smoke from the asphalt plant 10.

Figure 5:
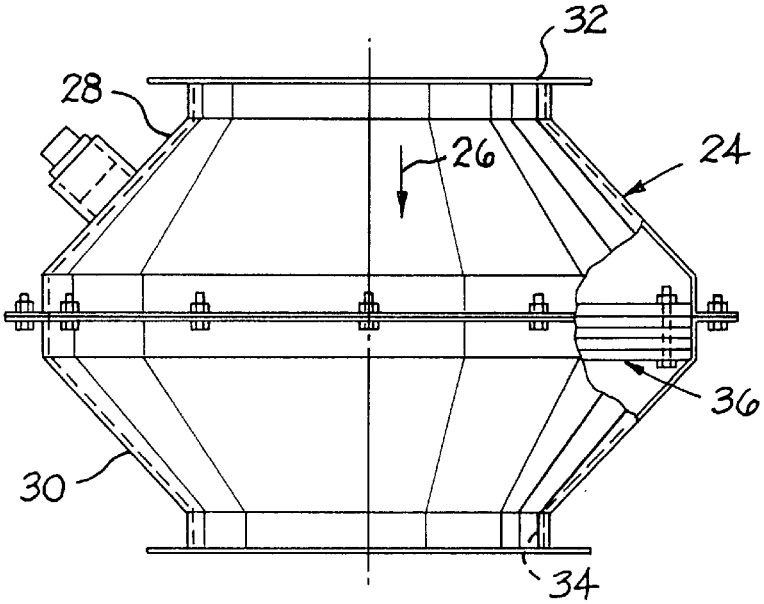
FIG. 5 is an enlarged view, partially broken away, of the flame arrester assembly of FIG. 1.
Figure 7:
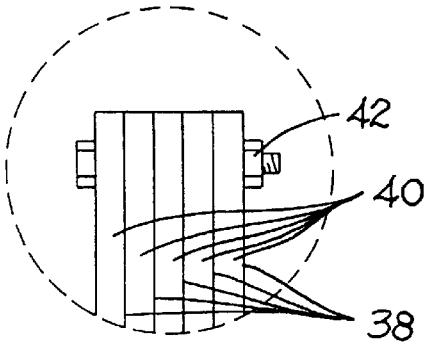
FIG. 7 is an enlarged view of a portion of the internal elements of FIG. 6.
Figure 6:
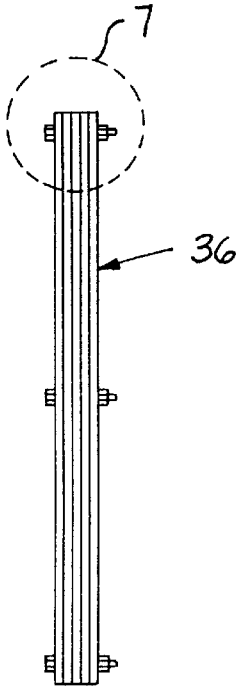
FIG. 6 is a view of the internal elements of the flame arrester assembly of FIG. 5.
Figure 8:
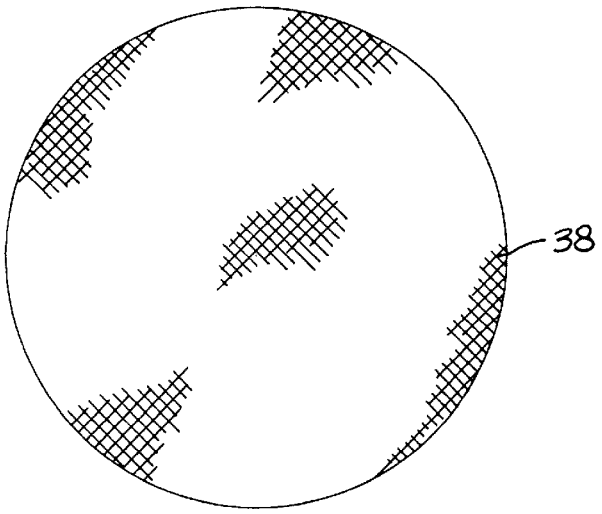
FIG. 8 is a bottom view of one of the mesh elements of the flame arrester of FIG. 5.
Figure 9:
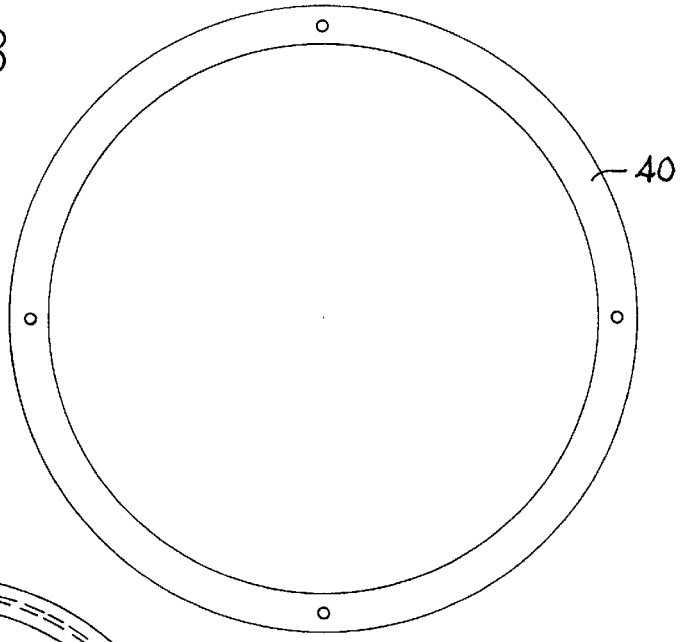
FIG. 9 is a bottom view of one of the clamp ring elements of the flame arrester of FIG. 5.
Figure 10:
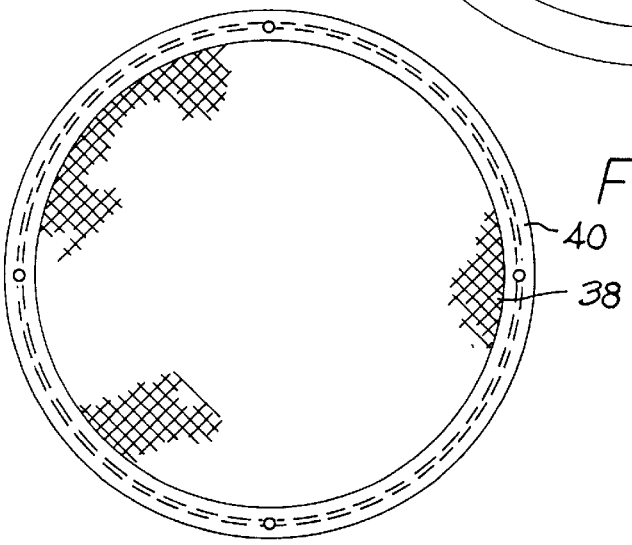
FIG. 10 is a bottom view of the element assembly of FIG. 5.
Figure 11:
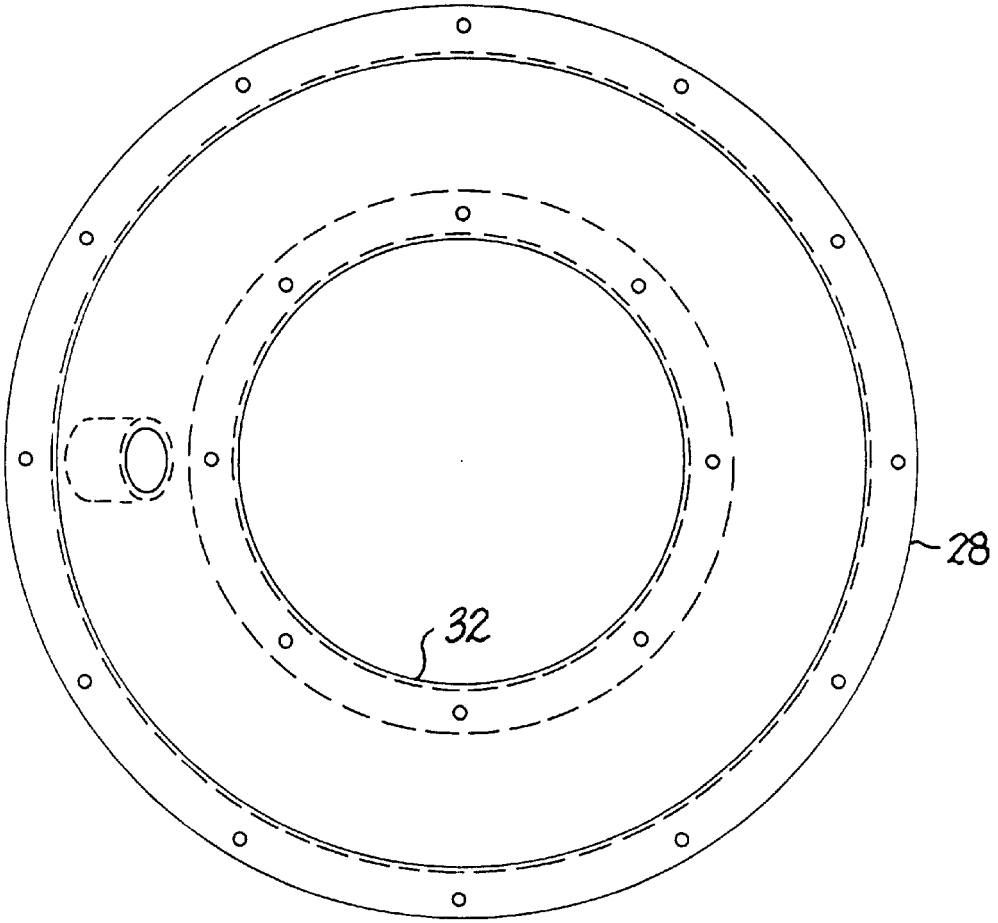
FIG. 11 is a bottom view of the top half of the housing of the flame arrester of FIG. 5.
Figure 12:
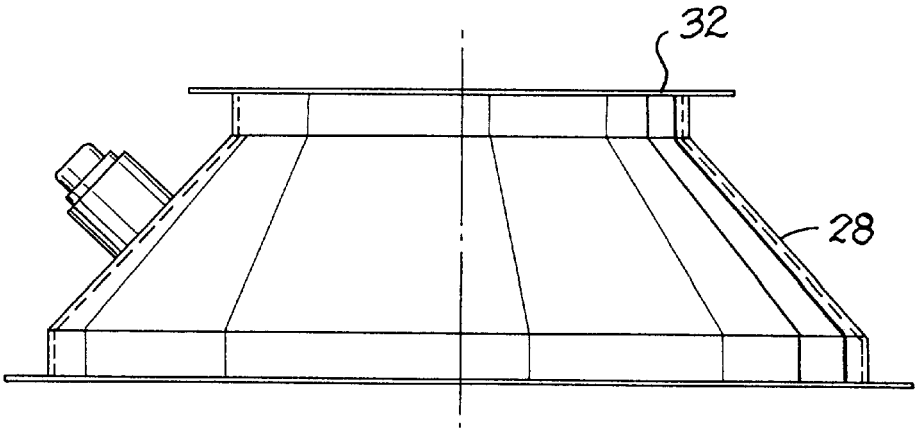
FIG. 12 is a side view of the top half of the housing of the flame arrester of FIG. 5.
Figure 13:
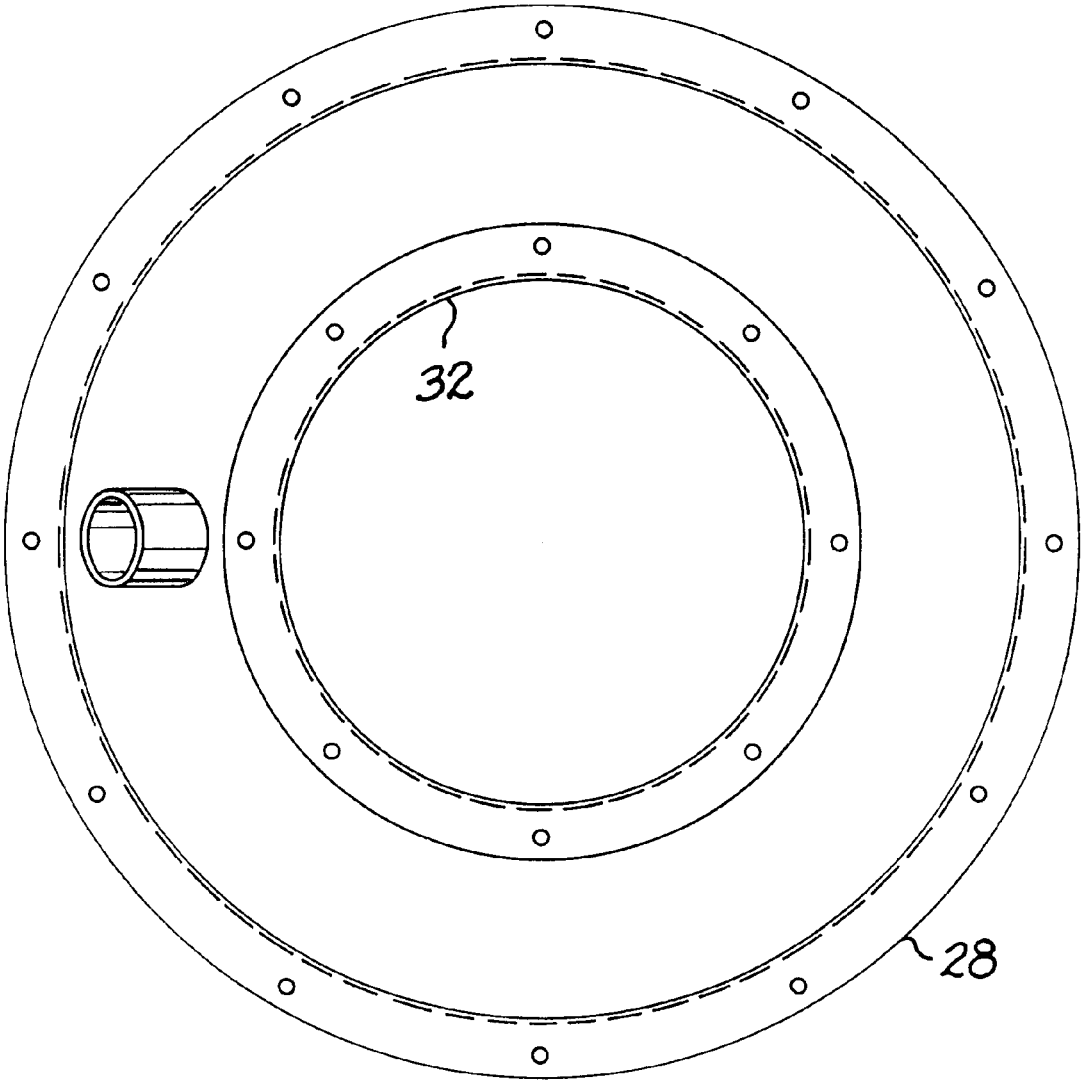
FIG. 13 is a top view of the top half of the housing of the flame arrester of FIG. 5.

FIG. 5 is an enlarged view of the flame arrester 24 shown in FIG. 1. FIGS. 6–13 show various parts of the flame arrester 24. The flame arrester 24 includes top and bottom shell halves 28, 30, which are bolted together and define a top opening 32 and a bottom opening 34. Air flows in the direction of the arrow 26 from the top opening 32, through the flame arrester 24, and out through the bottom opening 34.

Inside the flame arrester 24 is an element assembly 36 made up of mesh or grid elements 38 clamped between clamp rings 40. The element assembly 36 is bolted together so that several of the mesh elements 38 are parallel to and spaced from each other inside the flame arrester 24, the distance between parallel mesh elements 38 being the thickness of the clamp ring 40, which, in this preferred embodiment, is 0.025 inches. The mesh elements 38 are preferably made of stainless steel, and the clamp rings 40 and shell portions 28, 30 are preferably made of steel. The clamp rings 40 directly abut the shell portions 28, 30, so that heat is transferred from the emissions air to the mesh elements 38, then to the rings 40 and shell halves 28, 30, and finally to the ambient air.

The air passing through the flame arrester 24 goes directly to the burner 18, where the hydrocarbons in the air are burned. By transferring heat away from the air passing through the flame arrester, the flame arrester 24 keeps the air below its ignition temperature and prevents any flame from propagating back from the burner 18 into the emissions duct 22 to cause an explosion.

It will be obvious to those skilled in the art that modifications may be made to the preferred embodiment described above without departing from the scope of the present invention.

What is claimed is:

1. An asphalt plant, comprising:

a rotary dryer, including a burner, and defining a dryer solids inlet and a dryer solids outlet;

a rotary mixer, including a mixer inlet, located adjacent the dryer solids outlet so as to receive material from the rotary dryer; a liquid asphalt inlet; a mixer outlet; and a gas outlet;

a conduit extending from the mixer gas outlet to the burner of the rotary dryer; and a flame arrester grid in said conduit near the rotary dryer to prevent the propagation of flame from the burner into said conduit.

2. An asphalt plant as recited in claim 1, and further comprising a blower in communication with said conduit for drawing gases through said mixer, through said conduit, and to said burner.

3. An asphalt plant as recited in claim 2, wherein said flame arrester grid includes a plurality of grid elements; a plurality of rings, with the grid elements sandwiched between the rings; and a flame arrester housing in contact with said rings, so that heat is transferred from the air inside the conduit, to the grid elements, to the rings, to the housing, and out to the ambient air.

4. An asphalt plant as recited in claim 3, and further comprising an inlet for receiving recycled asphalt product into said mixer.

* * * * *